US008681466B2

(12) United States Patent
Annis et al.

(10) Patent No.: US 8,681,466 B2
(45) **Date of Patent: *Mar. 25, 2014**

(54) MAGNETIC CORE COUPLING IN A CURRENT TRANSFORMER WITH INTEGRATED MAGNETIC ACTUATOR

(75) Inventors: Jeffrey Annis, Waukesha, WI (US); Hans Weichert, Granichen (CH); Pascal Benz, Aarau (CH); Sandro Liberto, Aarau Rohr (CH); Beat Villiger, Reinach (CH)

(73) Assignee: Rockwell Automation Technologies, Inc., Mayfield Heights, OH (US)

( * ) Notice: Subject to any disclaimer, the term of this patent is extended or adjusted under 35 U.S.C. 154(b) by 327 days.

This patent is subject to a terminal disclaimer.

(21) Appl. No.: 13/162,852

(22) Filed: Jun. 17, 2011

(65) Prior Publication Data

US 2011/0242720 A1 Oct. 6, 2011

Related U.S. Application Data

(63) Continuation-in-part of application No. 12/762,894, filed on Apr. 19, 2010, now Pat. No. 8,427,803.

(60) Provisional application No. 61/176,677, filed on May 8, 2009.

(51) Int. Cl.
*H01H 73/00* (2006.01)

(52) U.S. Cl.
USPC ..... 361/115

(58) Field of Classification Search
USPC ..... 361/115
See application file for complete search history.

(56) References Cited

U.S. PATENT DOCUMENTS

| | | | |
|---|---|---|---|
| 2,712,043 | A | 6/1955 | Maupas |
| 3,688,227 | A | 8/1972 | Hong |

(Continued)

FOREIGN PATENT DOCUMENTS

| | | | |
|---|---|---|---|
| DE | 19721591 | A1 | 4/2010 |
| EP | 0626713 | A1 | 11/1994 |
| EP | 0841670 | | 5/1998 |
| EP | 1551039 | A2 | 4/2010 |
| WO | 0150569 | A2 | 7/2001 |

OTHER PUBLICATIONS

Office Action dated Oct. 5, 2012 for U.S. Appl. No. 13/177,946, 25 pages.

(Continued)

*Primary Examiner* — Dharti Patel
(74) *Attorney, Agent, or Firm* — Amin, Turocy & Watson, LLP

(57) ABSTRACT

A system comprising a magnetic actuator, a current transformer and operational electronics in a dual-coil circuit breaker. The system includes an inline, but non concentric, implementation of the primary and secondary coils to maintain a narrow width suitable for retrofitting in standard industrial rack mounted enclosures. The system further comprises an I-shaped lamination stack that is designed to abut on the ends of an upper and lower plate of the current transformer. The I-shaped lamination stack significantly increases the overlap between the lamination and the upper and lower plates, which results in lower magnetic reluctance and improves magnetic coupling.

20 Claims, 14 Drawing Sheets

(56) References Cited

U.S. PATENT DOCUMENTS

| | | | | |
|---|---|---|---|---|
| 3,760,309 | A | 9/1973 | Mcintosh et al. | |
| 3,932,791 | A | 1/1976 | Oswald | |
| 4,134,089 | A | 1/1979 | Chismar | |
| 5,532,895 | A | 7/1996 | Chiu | |
| 5,726,846 | A | 3/1998 | Houbre | |
| 6,414,575 | B1 | 7/2002 | Swift | |
| 6,445,268 | B1 | 9/2002 | Daum | |
| 6,560,084 | B1 | 5/2003 | Bilac et al. | |
| 7,012,800 | B2 | 3/2006 | Busch et al. | |
| 3,566,320 | A1 | 11/2010 | Bakes | |
| 8,456,782 | B2 * | 6/2013 | Annis et al. | 361/38 |
| 2004/0145846 | A1 | 7/2004 | Fasano | |
| 2010/0332046 | A1 | 12/2010 | Liberto et al. | |

OTHER PUBLICATIONS

OA dated Jun. 22, 2012 for U.S. Appl. No. 12/762,894, 26 pages.

ABB: "Emax Low Voltage Air Circuit-breakers. Technical Catalogue". Dec. 2008, pp. 1-278, XP002596845. http://www05.abb.com/global/scot/scot209.nsf/veritydisplay/3188b874c09378c2c12575a100532717/$File/1SDC200006D0206.pdf. Last accessed on Aug. 17, 2010, 16 pages.

European Search Report for EP Application No. 10158680.8-2214, dated Aug. 31, 2010, 11 pages.

European Search Report for EP Application Serial No. 12172356.3 mailed Feb. 8, 2013, 10 pages.

* cited by examiner

450

475

MAGNETIC CORE COUPLING IN A CURRENT TRANSFORMER WITH INTEGRATED MAGNETIC ACTUATOR

CROSS-REFERENCE TO RELATED APPLICATIONS

This application is a continuation in part of U.S. application Ser. No. 12/762,894, filed on Apr. 19, 2010, entitled "CURRENT TRANSFORMER WITH INTEGRATED ACTUATOR," which claims priority from European Application No. 10158680.8, filed on Mar. 26, 2010, and U.S. Application No. 61/176,677, filed on May 8, 2009. The entireties of each of the foregoing applications are incorporated herein by reference.

TECHNICAL FIELD

The subject innovation relates to industrial control systems and, more particularly, to systems and methods that provide improved magnetic core coupling in a current transformer having an integrated magnetic actuator.

BACKGROUND

Typical current motor protection circuit breakers, for rated currents up to approximately one hundred amperes, are designed with bimetal strips/heaters for thermal protection and magnetic plungers for short circuit protection. The operation of these devices produces a significant amount of power loss in the form of heat. The trend of government regulation and public opinion is towards a reduction in power consumption of all electrical devices, creating market pressure for more efficient electrical device designs. Further, reduced operating expenses are available to encourage the use of the design in new applications and to offset the cost of retrofitting existing applications with a more efficient circuit breaker.

Another shortcoming in the design of this class of conventional circuit breakers is the lack of integrated electronics for measuring circuit breaker conditions and the ability to communicate this data to a control system or network. Greater efficiency of operation and preventative maintenance opportunities are lost because the first sign of a problem with the circuit breaker is after the circuit breaker failure. Further, a high form factor with regard to the design's operational characteristics in this class of circuit breaker, such as speed of contact opening, prevention from reclosing, and/or prevention from welding, leads to higher manufacturing cost. Furthermore, the design of this class of conventional circuit breakers has a large size. In addition, in conventional designs, an excessive amount of magnetic flux is shunted away, which leads to a high level of breaker trip current and severely compromises the trip function of the circuit breaker. Moreover, the poor magnetic coupling can result in low transformation efficiencies, low secondary output current, and/or loss of current measurement linearity.

SUMMARY

The following presents a simplified summary in order to provide a basic understanding of some aspects of the disclosed innovation. This summary is not an extensive overview, and it is not intended to identify key or critical elements or to delineate the scope of the invention. Its sole purpose is to present some concepts in a simplified form as a prelude to the more detailed description presented later.

A new class of circuit breakers disclosed herein provides protection in a reduced form factor fitting and smaller enclosures. According to an aspect, the circuit breaker comprises an inline dual coil design targeted at reducing the width of the required enclosure and thus reducing the overall size. Moreover, the circuit breaker design employs a dual coil winding system of separate, but inline, coils to reduce the physical dimensions of the circuit breaker enclosure. Typically, the inline design allows the coil windings of the plunger system to act as the primary coil of a current transformer providing power for the embedded electronics. Further, an integrated magnetic actuator is included to provide fast contact opening when a short circuit is detected. In one aspect, magnetic coupling between a core upper and lower plate of the current transformer is improved by employing an I-shaped lamination stack which abuts the ends of these upper and lower plates.

According to an aspect of the invention, a system for a current transformer comprises: a primary coil component for providing current based short circuit protection; and a secondary coil component for providing voltage based overload protection; that are connected by upper and lower plates. In particular, a set of longitudinal lamination strips are embedded within the primary coil component to reduce the amount of shunted magnetic flux. Typically, the longitudinal lamination strips provide significantly better magnetic coupling than that in conventional designs, which results in higher transformation efficiencies, higher secondary output current, and higher current measurement linearity.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and is intended to include all such aspects and their equivalents. Other advantages and novel features will become apparent from the following detailed description when considered in conjunction with the drawings.

DETAILED DESCRIPTION

Figure 1:
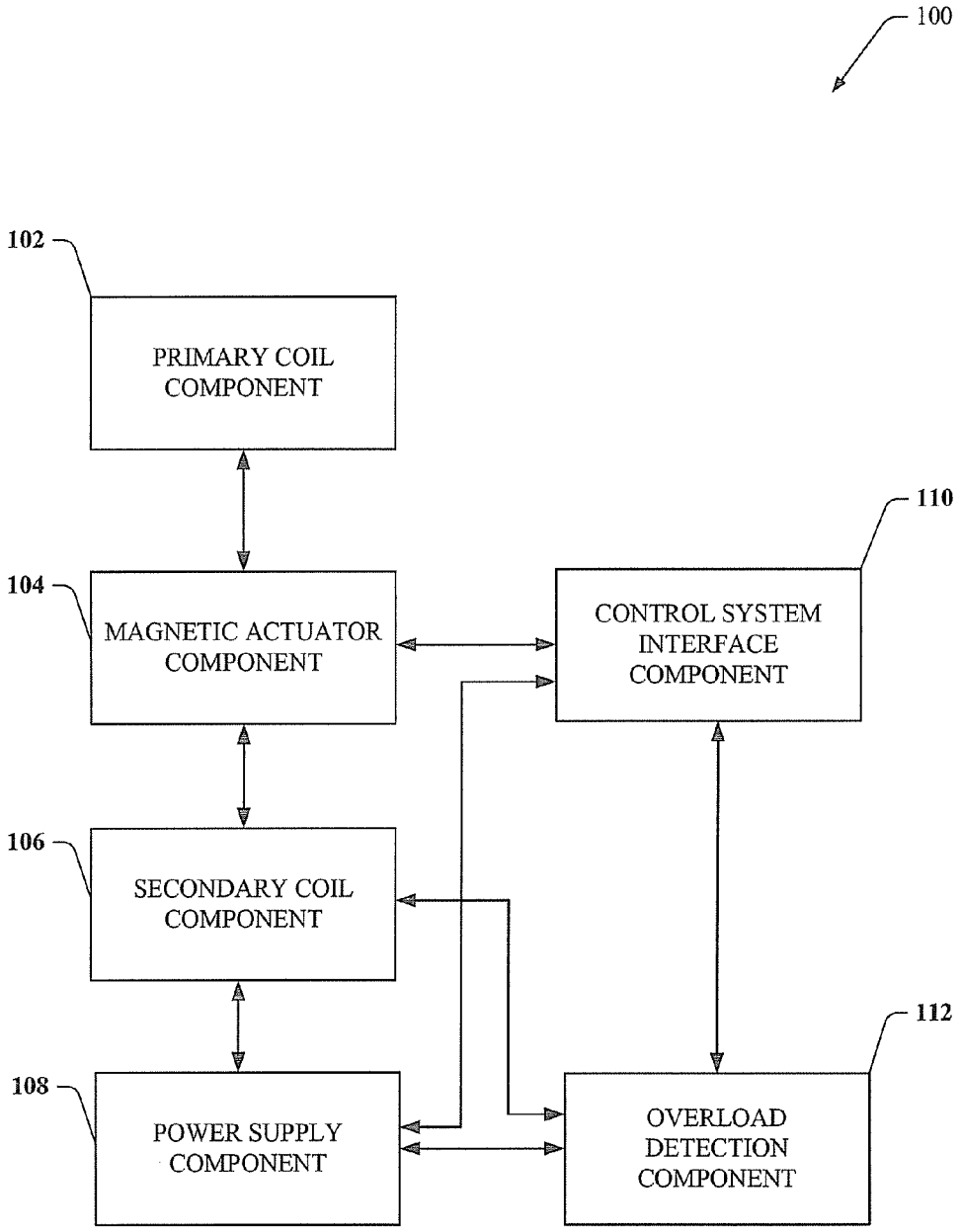
FIG. 1 depicts a block diagram of a current transformer with an integrated magnetic actuator and embedded electronics for measurement and communications.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details or with other methods, components, materials, etc. In other instances, well-known structures and devices are shown in block diagram form in order to facilitate a description thereof.

Reference throughout this specification to "one embodiment," or "an embodiment," means that a particular feature, structure, or characteristic described in connection with the embodiment is included in at least one embodiment. Thus, the appearances of the phrase "in one embodiment," or "in an embodiment," in various places throughout this specification are not necessarily all referring to the same embodiment. Furthermore, the particular features, structures, or characteristics may be combined in any suitable manner in one or more embodiments.

As used in this application, the terms "component," "system," "equipment," "interface", "network," and/or the like are intended to refer to a computer-related entity, either hardware, a combination of hardware and software, software, or software in execution. For example, a component can be, but is not limited to being, a process running on a processor, a processor, a hard disk drive, multiple storage drives (of optical and/or magnetic storage medium), an object, an executable, a thread of execution, a program, and/or a computer, an industrial controller, a relay, a sensor and/or a variable frequency drive. By way of illustration, both an application running on a controller and the controller can be a component. One or more components can reside within a process and/or thread of execution, and a component can be localized on one computer and/or distributed between two or more computers. As another example, an interface can include I/O components as well as associated processor, application, and/or API components.

In addition to the foregoing, it should be appreciated that the claimed subject matter can be implemented as a method, apparatus, or article of manufacture using typical programming and/or engineering techniques to produce software, firmware, hardware, or any suitable combination thereof to control a computing device, such as a variable frequency drive and/or controller, to implement the disclosed subject matter. The term "article of manufacture" as used herein is intended to encompass a computer program accessible from any computer-readable device or computer-readable storage/communications media. For example, computer readable media can include but are not limited to magnetic storage devices (e.g., hard disk, floppy disk, magnetic strips . . . ), optical disks (e.g., compact disk (CD), digital versatile disk (DVD) . . . ), smart cards, and flash memory devices (e.g., card, stick, key drive . . . ). Of course, those skilled in the art will recognize many modifications may be made to this configuration without departing from the scope or spirit of the claimed subject matter.

Moreover, the word "exemplary" is used herein to mean serving as an example, instance, or illustration. Any aspect or design described herein as "exemplary" is not necessarily to be construed as preferred or advantageous over other aspects or designs. Rather, use of the word exemplary is intended to present concepts in a concrete fashion. As used in this application, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

Referring to the drawings, FIG. 1 depicts a block diagram of a dual coil system 100 for a current transformer with an integrated magnetic actuator, and embedded electronics for measurement and communications. According to an embodiment, the dual coil system 100 includes a primary coil component 102, a combined magnetic actuator/current transformer (CT)-core component 104, a secondary coil component 106, a power supply component 108, a control system interface component 110 and an overload detection component 112. In one example, the current transformer can be utilized in a circuit breaker. Typically, the dual coil system 100 can provide a cost effective integration of electronic overload protection into standard-sized motor protection circuit breakers, especially of relatively small frame sizes (e.g., up to 63A, 140M-D, and 140M-F). Moreover, the current transformer measures a current flowing through a power system and inputs the measured current to an overload protection system, for example, that causes a circuit breaker to trip if the current is above a specific threshold. In one example, the secondary coils from all three phases are connected through a rectifying bridge and provide power for the device (power supply component 108). In another example, an external power supply to this device, can also be utilized, but cannot be as cost effective and can require additional wiring.

The primary coil component 102 is the current coil and provides sufficient windings to provide power for the power supply component 108, for the control system interface component 110 and for the overload detection component 112 and to act as the measurement device for the primary current. The primary coil component 102 wraps a plunger component and is implemented separately from the secondary coil component 106 but in-line with the secondary coil component 106 to reduce enclosure size requirements. Typically, the primary coil component 102 and the secondary coil component 106 are connected by an upper and lower plate (CT-core). In one aspect, an I-shaped lamination stack is utilized to improve the magnetic coupling between the upper and lower plates. As an example, the lamination stack can include a set of insulated sheets parallel, or substantially parallel, with the lines of flux. Moreover, the I-shaped lamination stack reduces/prevents eddy currents and accordingly improves the magnetic coupling between the upper and lower plates.

The magnetic actuator component 104 simultaneously provides an instantaneous trip and an induced delay trip capability. The magnetic actuator component 104 is not susceptible to the inefficient power based heat generation problems of bimetal thermal overload detectors. The magnetic actuator component 104 implements integrated mechanical movement of the plunger and the armature based on magnetic field strength driven by current load of the primary coil component 102 to break the contacts in a short circuit condition. As one non-limiting example, the magnetic actuator component 104 is designed as a spring loaded plunger acting as the armature of the primary coil component 102. Typically, the current in the primary coil component 102 can be measured indirectly by measuring the voltage drop across a burden resistor connected to the secondary coil component 106.

The secondary coil component 106 provides the voltage coil for allowing power supply of the electronics and detection of overload conditions. As previously described, the implementation of the design includes separate coils that are oriented inline to allow the use of a smaller form factor enclosure. As one example of the differences in the subject innovative design and a conventional design, is that a conventional design can include concentric dual coils. The physical geometry of requiring a secondary coil to wrap around the outer diameter of the primary coil prohibits the reduction in size of the enclosure because of the width requirements of the concentric coils.

The power supply component 108 provides power for the integrated measurement and communication aspects of the control system interface component 110. The power supply component 108 derives its source from the windings of the secondary coil component 106 and is designed to match the power supply requirements of the control system interface component 110. Moreover, under fault (e.g., short circuit) conditions, the core will saturate and limit excess current/power from being delivered to the control system electronics. The control system interface component 110 provides the electronics for the measurement of circuit breaker related data and the communication of the circuit breaker related data to other devices communicatively connected to the control system interface component 110. The control system interface component 110 collects data, such as, but not limited to, current flow of the primary coil, voltage of the secondary coil, temperature of the enclosure and its components and/or tripping events associated with overload conditions or remote shutdown. The control system interface component 110 communicates the collected information to most any devices communicatively connected to the control system interface component 110.

The overload detection component 112 provides for detecting a current overload in the primary coil based on an increasing magnetic field strength surrounding the magnetic actuator component 104, and the voltage overload in the secondary coil component 106 based on a remote shutdown supply voltage. The mechanisms of overload detection component 112 provide for instantaneous shutdown in short circuit conditions, but also allow delayed shutdown for overload conditions not involving a short circuit. In another aspect, the shutdown mechanisms disclosed herein accomplish this task without the inefficient generation of heat, as generated in conventional systems having a bimetal design for overload protection. It can be appreciated that although the improved CT design disclosed herein is described with respect to a circuit breaker system, the subject innovation is not that limited and the disclosed CT design can be incorporated within most any current transformer, for example, utilized in most any power measurement devices and applications, including, but not limited to protective relays, analog devices, transducers, and/or PowerMonitor™ products.

Referring now to FIGS. 2A-D, the inline design of the dual coil system 100 is illustrated, wherein the magnetic actuator component 104 comprises a plunger type actuator 202, the primary coil component 102 comprises a current measuring primary coil 208 and the secondary coil component 106 comprises a current measuring secondary coil 210, wherein a voltage across the secondary coil 210 is measured, for example, by passing the secondary current through a burden resistor (not shown) and measuring the resulting burden resistor voltage drop. FIGS. 2A-D depict various views (200, 250) and cross-sections (225, 275) of the dual coil system 100. As seen from FIGS. 2A-D, the dual coil system 100 includes an inline (non-concentric) primary coil 208 and secondary coil 210 that enable the placement of the system 100 in standard enclosure designs (e.g., standard frame sizes). Typically, primary coil 208 has sufficient windings to provide enough power to support the data collection and the network communication, performed by the control system interface component 110. In one example, current in the primary coil 208 can be measured indirectly by measuring the voltage drop across a burden resistor (not shown) connected to the secondary coil 210.

Figure 2A:
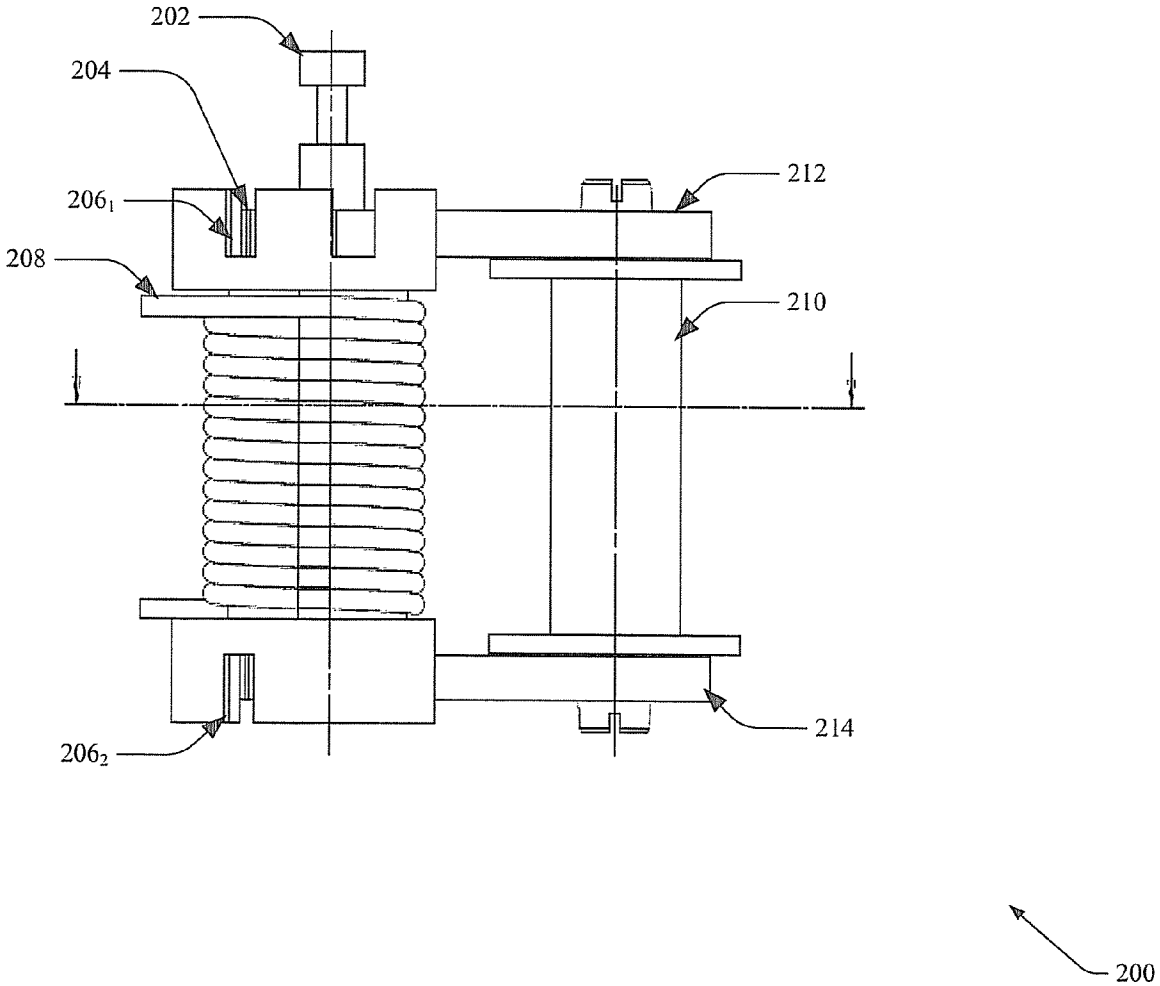
FIGS. 2A-D depict an inline design of the dual coil system with an integrated magnetic actuator and I-shaped laminations.

FIG. 2A illustrates an elevation (side view) 200 of the dual coil system 100. In one aspect, the inline primary coil 208 and secondary coil 210 are connected to a top plate 212 and a bottom plate 214 (e.g., by employing screws). Typically, the dual coil system 100 can be utilized in a circuit breaker, for example, in motor control/protection (e.g., in manual motor controllers). In one aspect, the coil of the magnetic plunger 202 is additionally used as a primary winding 208 of the current transformer, which provides power and current measurement signal to an electronic circuit (e.g., in the control system interface component 110). Typically, the amount of magnetic flux shunted away from the plunger actuator 202 is reduced by utilizing longitudinal lamination strips 204 embedded within the primary coil bobbin. As an example, an I-shaped lamination stack 204 is designed to abut to the ends of the current transformer top plate 212 and bottom plate 214. According to an embodiment, the I-shape significantly increases the surface area (e.g., overlap) between the lamination 204 with the ends of the top plate 212 and bottom plate. The increased surface area lowers magnetic reluctance and improves magnetic coupling. In addition, the I-shaped laminations 204 are flexible in torsion and can self-align to the end plate surfaces through the use of a spring clip ($\mathbf{206}_1$, $\mathbf{206}_2$). Moreover, the torsional flexibility of thin I-shaped laminations allows for self alignment to the ends of upper/lower plates 212 and 214. This self alignment reduces the air gap between mating parts and make the assembly more robust from a manufacturing standpoint. The spring clip ($\mathbf{206}_1$, $\mathbf{206}_2$) enables minimizing air gaps in the I-shaped laminations 204, resulting in higher transformation efficiencies, higher secondary output current, and improved current measurement linearity.

Figure 2B:
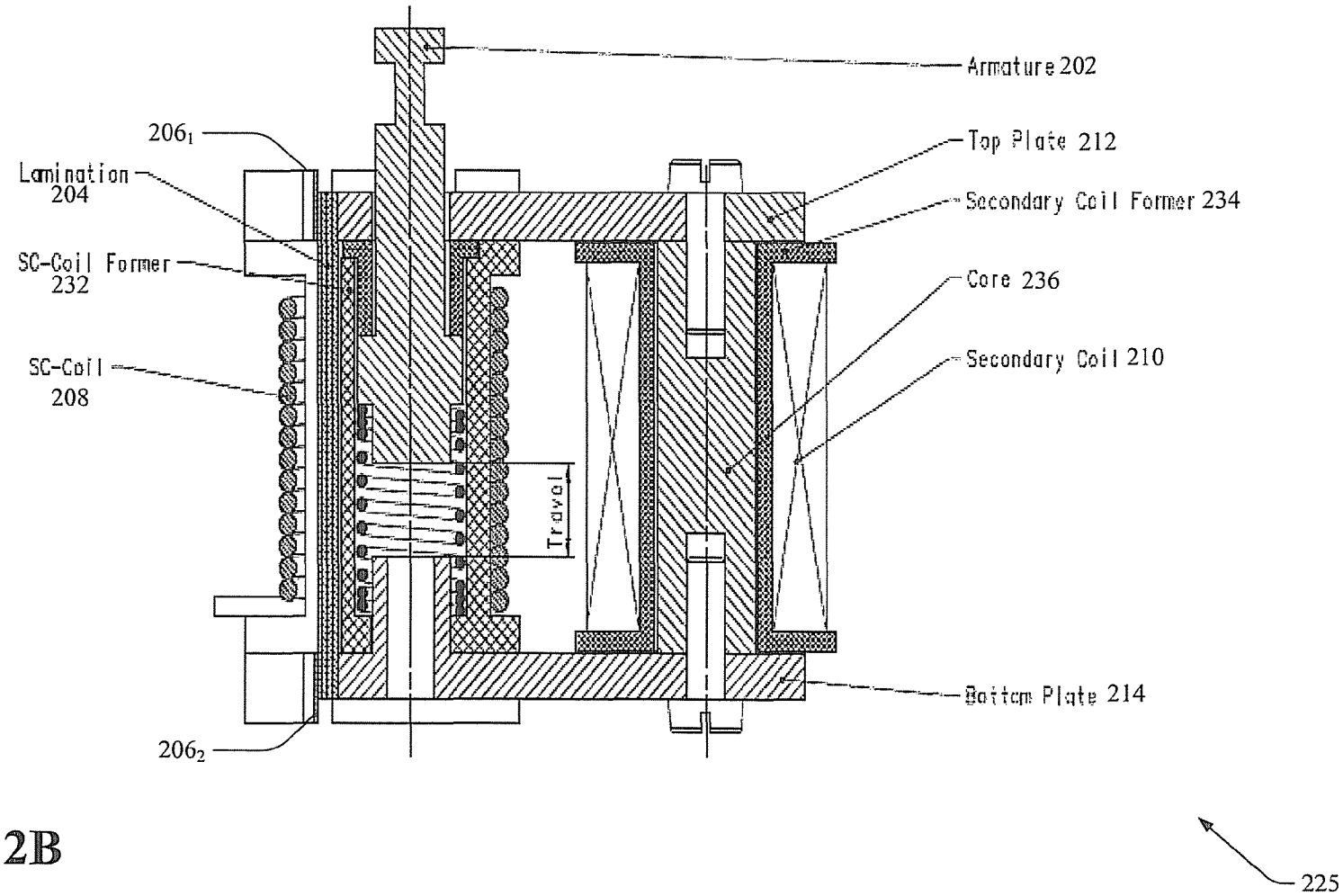
Figure 2C:
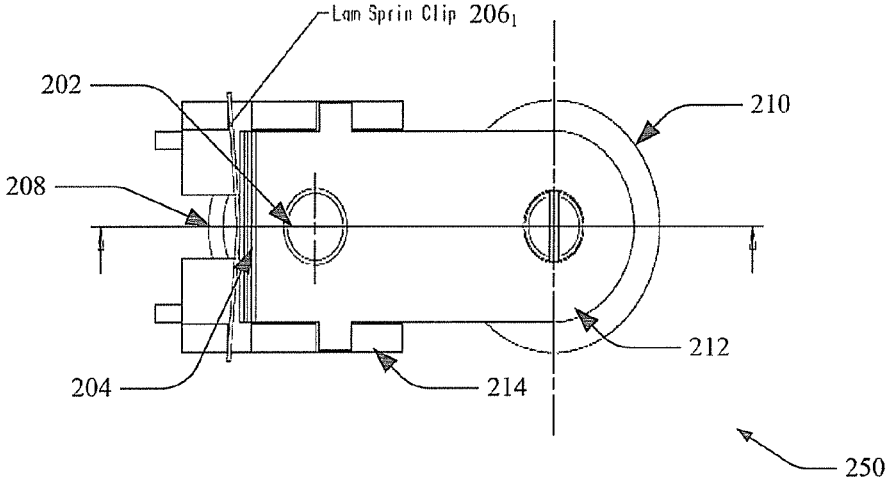
Figure 2D:
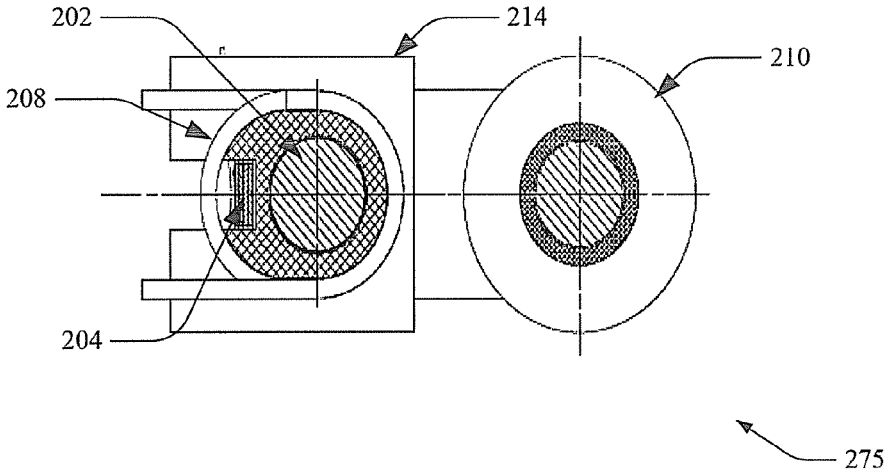

FIG. 2B illustrates a vertical cross section 225 and FIG. 2D illustrates a horizontal cross section of the dual coil system 100 depicting the I-shaped lamination stack 204, that improves the magnetic coupling between the top plate 212 and the bottom plate 214 of a current transformer. Further, FIG. 2C illustrates a top view 250 of the dual coil system 100 that includes the I-shaped lamination stack 204, integrated within the primary bobbin design. Typically, the I-shaped lamination stack 204 can twist and self-align with the ends of the top plate 212 and bottom plate 214. In an aspect, the spring clip ($\mathbf{206}_1$, $\mathbf{206}_2$) can apply a spring force to the lamination stack 204 to form a tight interface, with no (or minimum) air gaps, between the lamination stack 204 and the top plate 212 and the bottom plate 214.

Although an "I" shape for the lamination stack 204 is described herein, it can be appreciated that the subject innovation is not so limited and most any shape that provides increased surface area between the laminate stack 204 and the top plate 212 and bottom plate 214 can be utilized. Further, it can be appreciated that although the "I" shape for the lamination stack 204 described herein, is symmetrical, an asymmetrical shape can also be utilized.

Figure 3A:
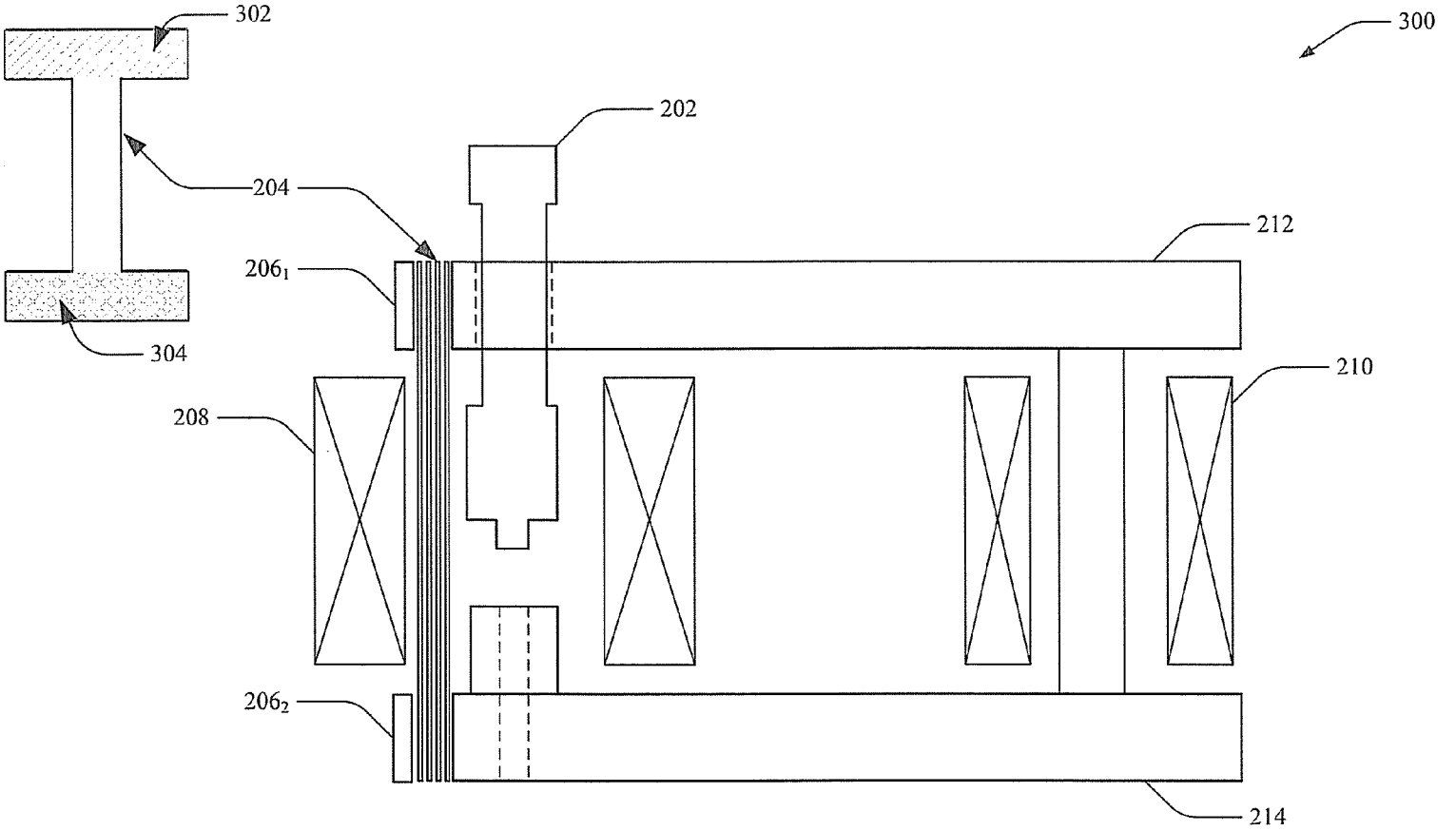
FIGS. 3A-B depict example embodiments that improve magnetic core coupling in a current transformer with an integrated magnetic actuator.

Referring now to FIG. 3A, there illustrated is an example embodiment 300 that improves magnetic core coupling in a current transformer with an integrated actuator, by employing I-shaped laminations. Specifically, FIG. 3A depicts a simplified vertical cross sectional view of the current transformer with the integrated actuator. In one aspect, the current transformer with the integrated actuator includes a primary bobbin design which nests an upper plate, 212, a bottom plate 214, I-shaped laminations 204 and lamination spring clips ($\mathbf{206}_1$, $\mathbf{206}_2$). As an example, the laminations 204 reduce magnitude of eddy currents by confining the eddy currents to highly elliptical paths that enclose very little flux and accordingly improve magnetic coupling. In one aspect, the thickness of the laminations in the lamination stack 204 can vary based on an application. For example, thin laminations are generally used in high frequency transformers. Typically, the thicker the laminations, the greater are the eddy current losses. However, thicker laminations are relatively easier to construct and cheaper than the thinner laminations. However, thinner laminations reduce losses generated by the eddy currents.

In one aspect, clips, for example, spring clips ($\mathbf{206}_1$, $\mathbf{206}_2$) can be utilized to tightly interface the lamination stack 204 with the upper plate 212 and the bottom plate 214. Spring clips ($\mathbf{206}_1$, $\mathbf{206}_2$) tighten the lamination stack 204 such that air gaps between the laminations and the upper plate, 212 and the bottom plate 214 are minimum. Typically, the upper portion 302 of the I-shape lamination increases overlap with the upper plate 212, while the bottom portion 304 of the I-shape lamination increases overlap with the bottom plate 214. Accordingly, surface area of the lamination stack 204, in contact/overlap with the upper plate 212 and the bottom plate 214 increases and air gap is reduced. This significantly improved the magnetic coupling between the upper and lower plates (212, 214) and the lamination stack 204.

Figure 3B:
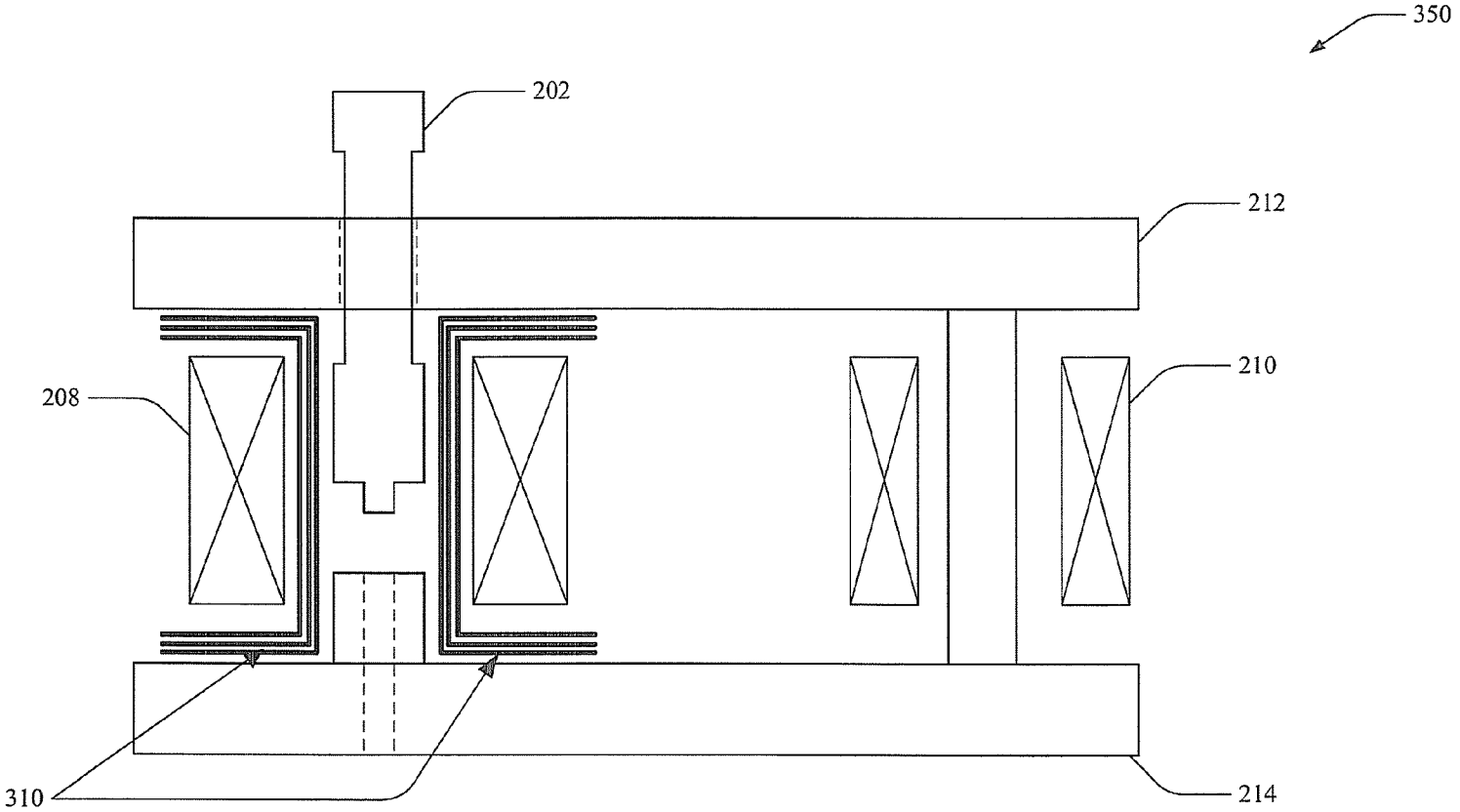
Figure 4A:
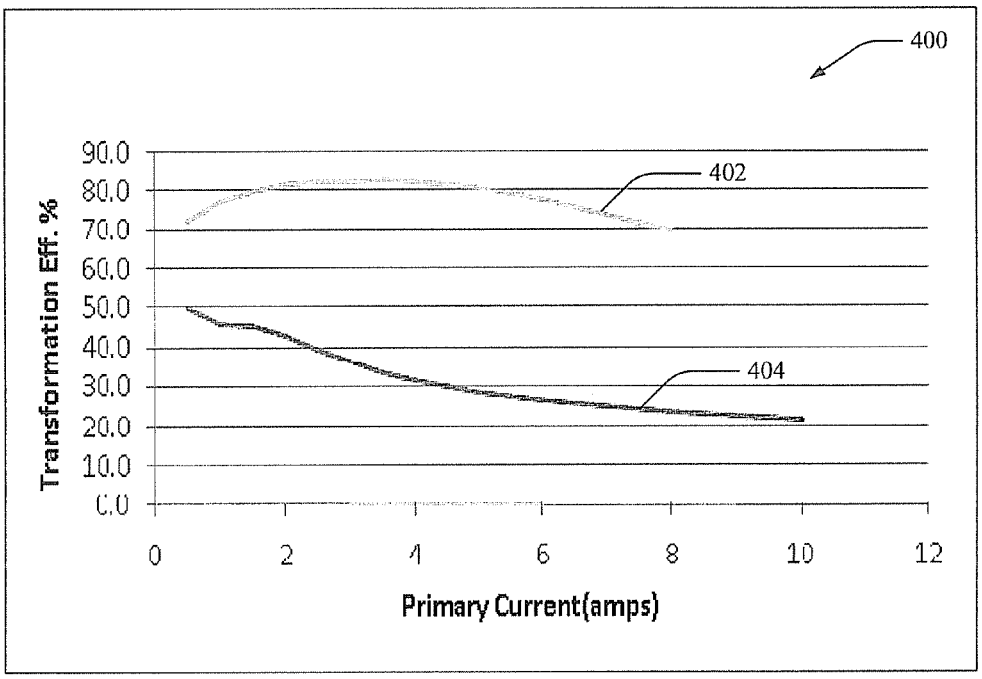
FIGS. 4A-D depict graphs illustrating changes in transformation efficiency, output current, and current linearity of a current transformer with an integrated magnetic actuator that utilizes an I-shaped lamination stack.
Figure 4B:
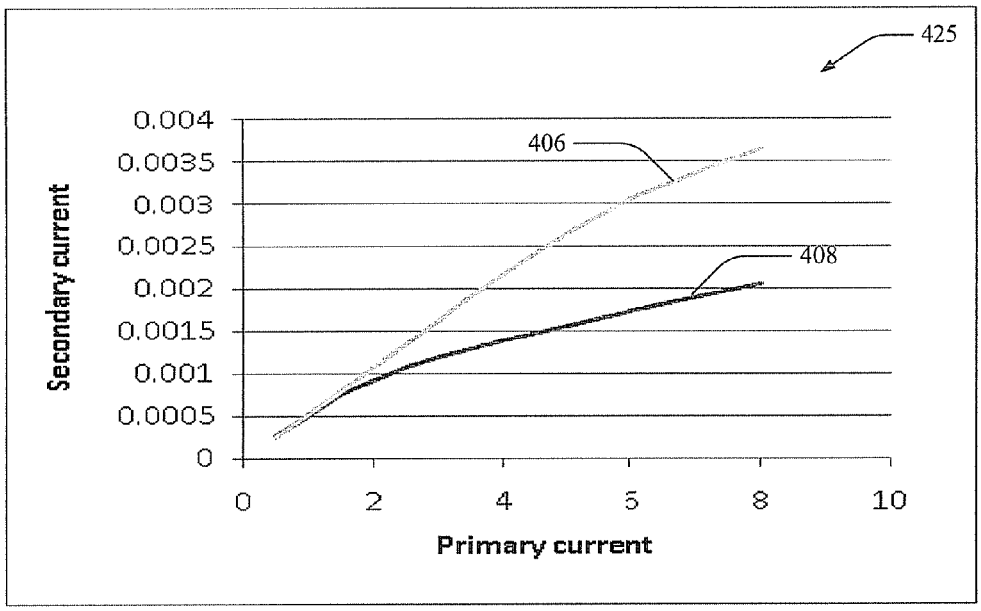
Figure 4C:
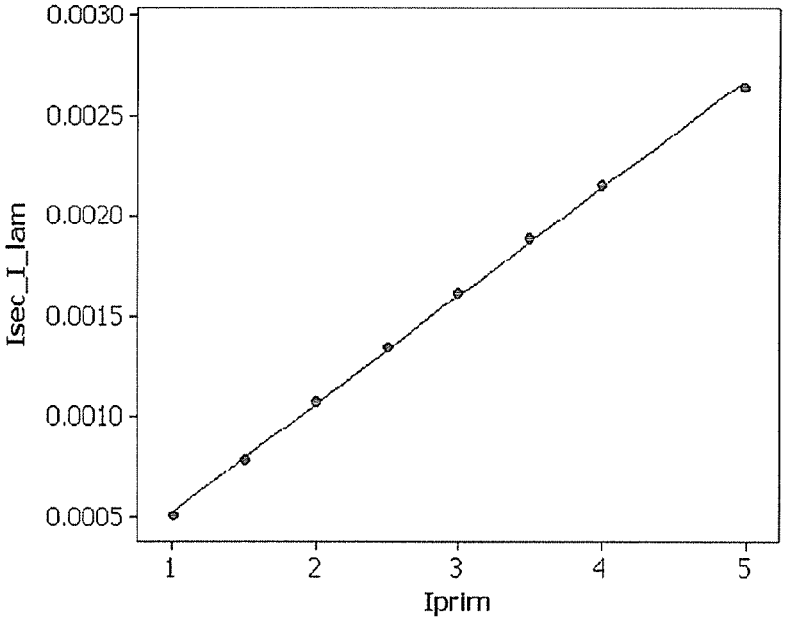
Figure 4D:
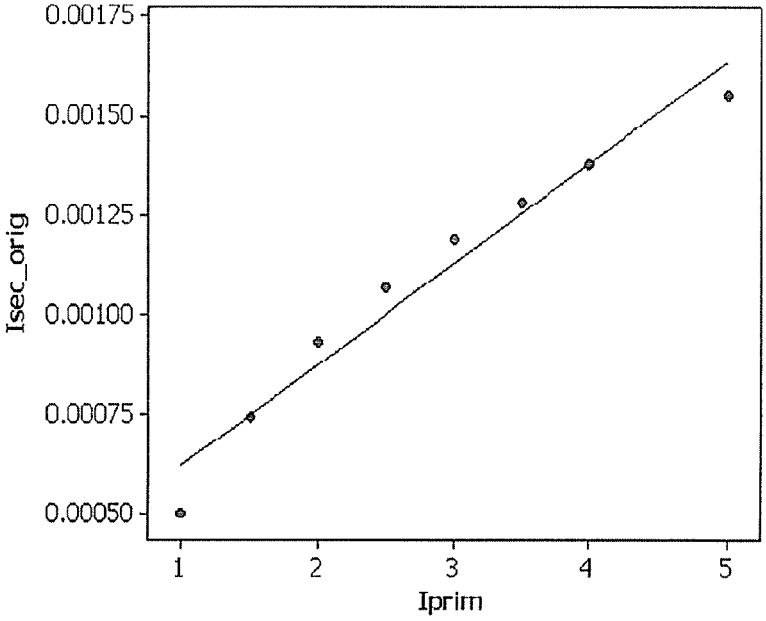

FIG. 3B illustrates an alternate embodiment 350 that improves magnetic core coupling in a current transformer with an integrated actuator by employing C/U-shaped laminations. According to an aspect, FIG. 3B depicts a simplified vertical cross sectional view of the current transformer with the integrated actuator that utilizes a C/U-shaped lamination stack 310. In one embodiment, the C-shaped or U-shaped lamination stack 310 abuts the upper and lower surfaces of the lower plate 214 and the upper plate 212 respectively. Similar to the I-shaped lamination stack 204, the C-shaped or U-shaped lamination stack 310 overlaps with the upper plate 212 and the bottom plate 214, to improve magnetic coupling between the lamination stack 310 and the upper and lower plates (212, 214). Accordingly, the C-shaped or U-shaped lamination stack 310 can provide improved transformation efficiencies, secondary output current and current measurement linearity. It can be appreciated that the C-shaped or U-shaped laminations can be tightly interfaced with the upper plate 212 and the bottom plate 214, to reduce air gaps between them.

FIGS. 4A-D illustrate graphs 400-475 that depict changes in transformation efficiency, output current, and current linearity in a current transformer with integrated magnetic actuator that utilizes an I-shaped lamination stack, as discussed supra. As an example, the current transformer design with I-shaped laminations can utilize 15 primary turns compared to 25 turns utilized for a current transformer design without I-shaped laminations. Graph 400 represents the transformation efficiency (in percentage) of the current transformer as a function of primary current (in amperes). As seen from graph 400, the transformation efficiency 402 when I-shaped laminations are included within the design of current transformer, is significantly greater than the efficiency 404 when the I-shaped laminations are not included. Moreover, the efficiency 402 is higher than efficiency 404 for all values of primary current. Further, graph 450 represents the secondary current (in amperes) of the current transformer as a function of primary current (in amperes). Here too, similar improvements are observed by utilizing the I-shaped laminations. Moreover, the secondary current 406, when I-shaped laminations are included within the current transformer design, is larger compared to the secondary current 408 obtained when the I-shaped laminations are not included. Furthermore, graphs 450 and 475 display the current measurement accuracy and linearity, with and without I-shaped laminations within the design of current transformer respectively. As seen the graph 450 depicts substantial improvement in the current measurement accuracy and linearity as compared to graph 475.

Figure 5:
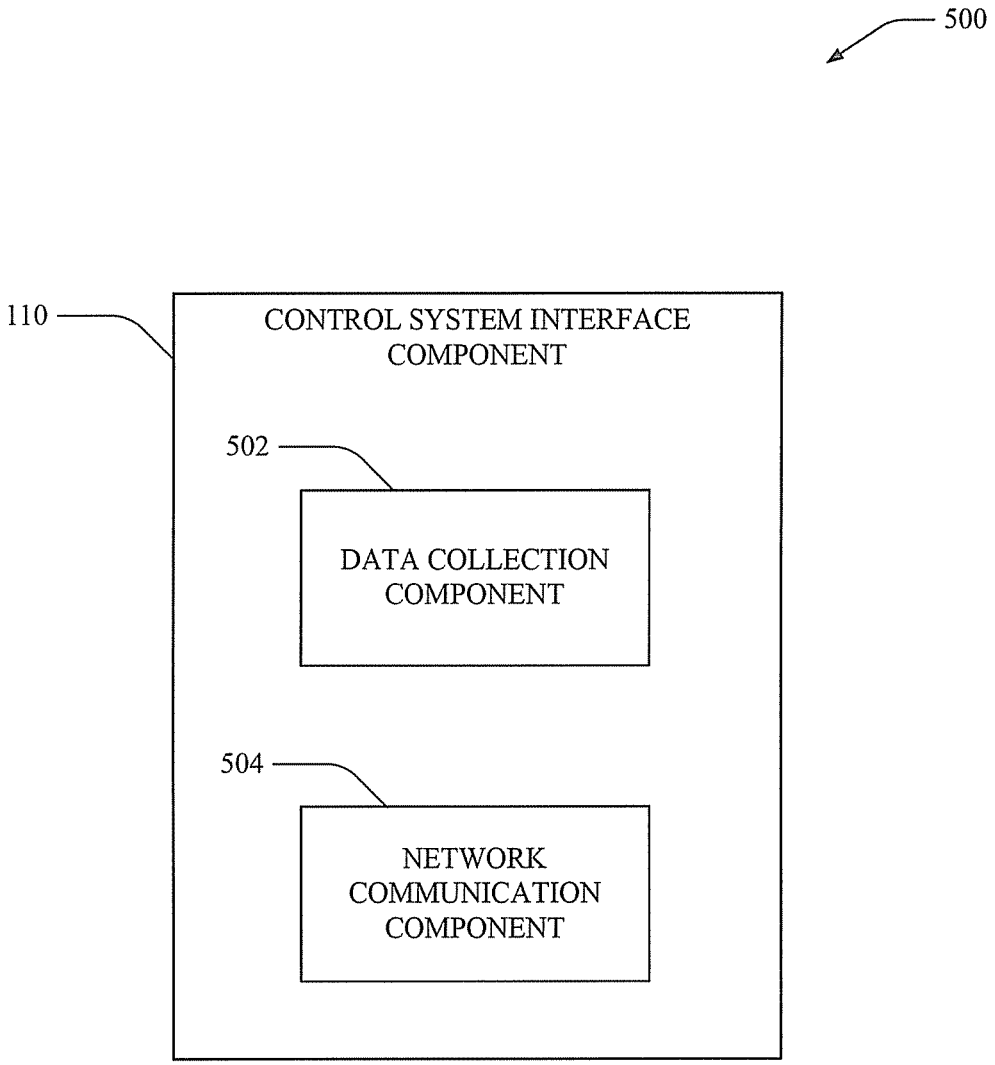
FIG. 5 depicts a block diagram of the control system interface of a current transformer with an integrated magnetic actuator.

Referring to FIG. 5, there depicted in 500 the control system interface component 110 including the data collection component 502 and the network communication component 504. The data collection component 502 comprises measurement electronics suitable to measure the current of the primary coil component 102, the voltage of the secondary coil component 106, the voltage of the power supply component 108, the temperature of the enclosure components and/or the load exerted on a deflection spring of the plunger 202. The data measurements available to the data collection component 502 are provided to the network communication component 504 for transmission to other devices communicatively coupled to the control system interface component 110. The data can be processed and/or provided to another device for further analysis. In one aspect, the measurement electronics are protected from short circuit fault events due magnetic saturation of transformer core 236 which limits maximum current flow to the secondary coil 210.

The network communication component 504 provides the ability to communicate with other devices on a network. For example, an industrial controller can interrogate the network communication component 504 over a control network and request the values of any data measureable by the data collection component 502. Further, the industrial controller can request the value of the current measurement for the primary coil and/or the temperature of the enclosure. The network communication component 504 can package the requested data in a format suitable for transfer over the connected control network and transmit the data to the requesting device.

In another aspect, the network communication component 504 can receive a communication comprising a command to perform an action, such as, but not limited to, opening the contacts. Upon receiving such a command, the network communication component 504 directs an overload voltage to the secondary coil and performs a remote shutdown. In another aspect, the network communication component 504 can communicate the occurrence of a shutdown, for any reason and by either coil, to a device communicatively coupled to the network communication component 504, without a prior request from the device for the data.

Figure 6:
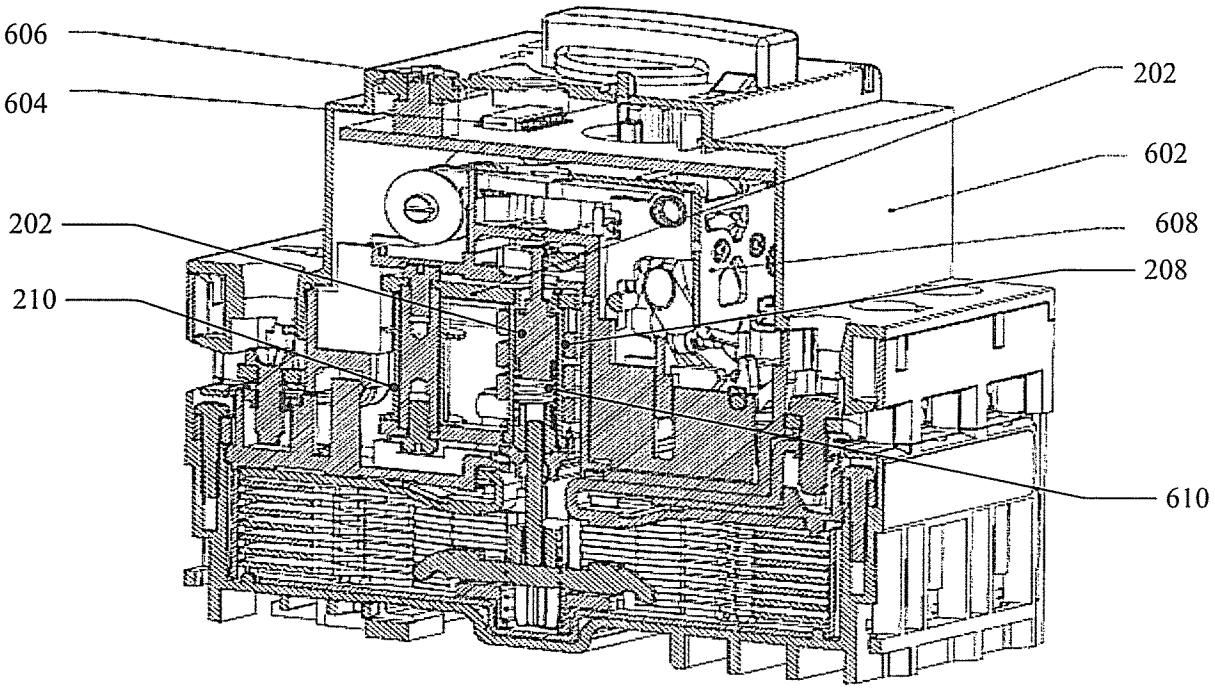
FIG. 6 depicts a three-dimensional representation of a reduced size enclosure containing a current transformer with an integrated magnetic actuator and I-shaped laminations.

Referring to FIG. 6, a three-dimensional depiction of the inline dual coil system enclosed within a enclosure 602 is illustrated. The dual coil system includes an inline primary coil 208 and secondary coil 210, the plunger 202, a magnetic shunt 610, the control system interface component 110 comprising electronics 604, and a network connection 606 to facilitate communication by the control system interface component 110. In one aspect, an I-shaped lamination stack 204 is enclosed within the primary coil bobbin. Further, the width of the enclosure 602 requires a narrow coil design and a current transformer with concentric coils will not fit within the enclosure 602, due to its large width. In contrast, the subject inline dual coil system has a smaller width and thus fits into the enclosure 602. According to one aspect, the electronics 604 are powered from the additional windings of the secondary coil 210 and provide for data collection and bidirectional communication to other devices on the communicatively connected network for example, via the network connection 606. Typically, the electronics 604 are protected from short circuit fault events due magnetic saturation of transformer core 236 which limits maximum current flow to the secondary coil 210. The network connection 606 port provides the point of attachment for a network cable suitable to position the enclosure in existing control component mounting racks.

Figure 7:
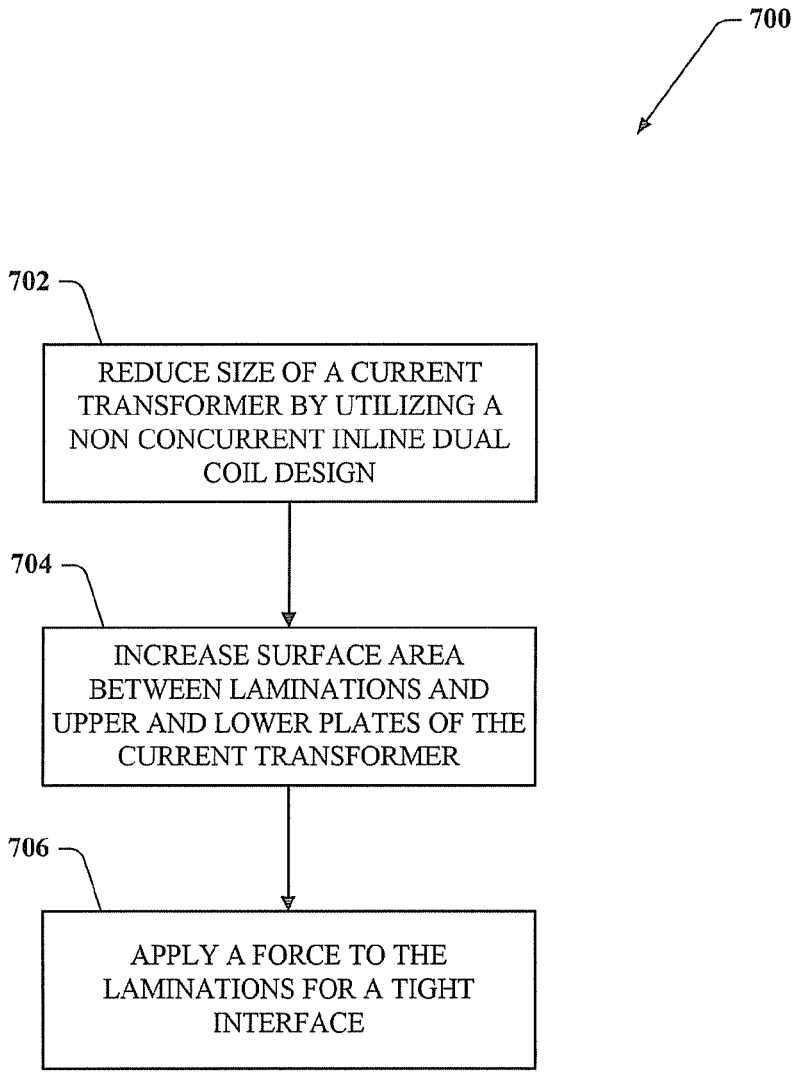
FIG. 7 depicts an example methodology to improve magnetic coupling in a current transformer with an integrated magnetic actuator.

FIG. 7 illustrates an example methodology and/or flow diagram in accordance with the disclosed subject matter. For simplicity of explanation, the methodology is depicted and described as a series of acts. It is to be understood and appreciated that the subject innovation is not limited by the acts illustrated and/or by the order of acts, for example acts can occur in various orders and/or concurrently, and with other acts not presented and described herein. Furthermore, not all illustrated acts may be required to implement the methodologies in accordance with the disclosed subject matter. In addition, those skilled in the art will understand and appreciate that the methodologies could alternatively be represented as a series of interrelated states via a state diagram or events. Additionally, it should be further appreciated that the methodologies disclosed hereinafter and throughout this specification are capable of being stored on an article of manufacture to facilitate transporting and transferring such methodologies to computers. The term article of manufacture, as used herein, is intended to encompass a computer program accessible from any computer-readable device, carrier, or media.

At 702, the size of a current transformer, with an integrated magnetic actuator, is reduced by employing a non concentric inline dual coil design. Since the coils are not concentric, the width of the current transformer can be significantly decreased. At 704, surface area between laminations and an upper and lower plate of the current transformer is increased. In one example, I-shaped laminations are integrated within a primary coil bobbin. The I-shaped laminations abut to the ends of the upper and lower plates and accordingly increase surface area of contact/overlap. Moreover, the increased surface area improves magnetic coupling of the current transformer. At 706, a force is applied to the laminations to tighten the interface between the laminations and the upper and lower plates. For example, spring clips can be employed to apply a spring force that tightly abuts the laminations to the ends of the plates while reducing air gaps.

Figure 8:
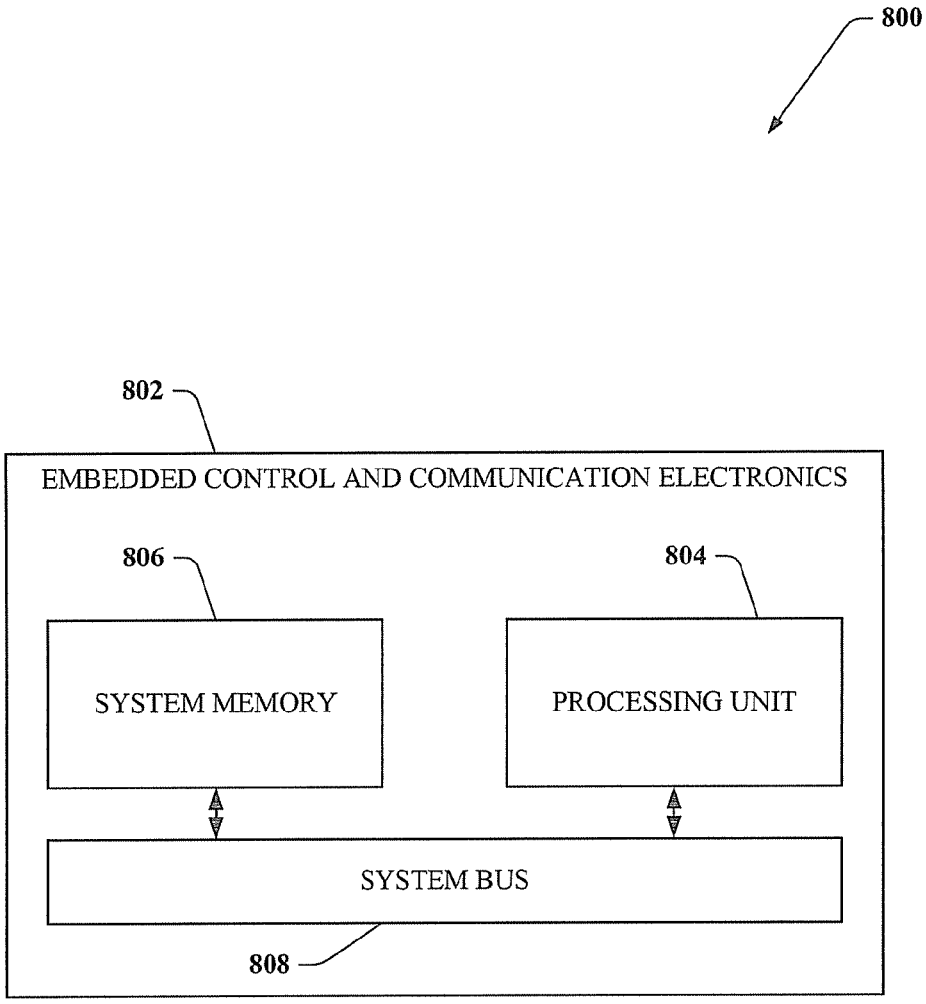
FIG. 8 a schematic block diagram illustrating a suitable operating environment for the embedded control and communication electronics.

With reference to FIG. 8, the exemplary computing environment 800 for implementing various aspects of the subject innovation, which includes embedded control and communication electronics 802, including a processing unit 804, a system memory 806 and a system bus 808. The system bus 808 couples system components including, but not limited to, the system memory 806 to the processing unit 804. The processing unit 804 can be any of various commercially available processors, such a single core processor, a multi-core processor, or any other suitable arrangement of processors. The system bus 808 can be any of several types of bus structure that can further interconnect to a memory bus (with or without a memory controller), a peripheral bus, and a local bus using any of a variety of commercially available bus architectures. The system memory 806 can include read-only memory (ROM), random access memory (RAM), high-speed RAM (such as static RAM), EPROM, EEPROM, and/or the like. Additionally or alternatively, the computer 802 can include a hard disk drive, upon which program instructions, data, and the like can be retained. Moreover, removable data storage can be associated with the embedded control and communication electronics 802. Hard disk drives, removable media, etc. can be communicatively coupled to the processing unit 804 by way of the system bus 808.

The system memory 806 can retain a number of program modules, such as an operating system, one or more application programs, other program modules, and program data. All or portions of an operating system, applications, modules, and/or data can be, for instance, cached in RAM, retained upon a hard disk drive, or any other suitable location. A user can enter commands and information into the embedded control and communication electronics 802 through one or more wired/wireless input devices, such as a keyboard, pointing and clicking mechanism, pressure sensitive screen, microphone, joystick, stylus pen, etc. A monitor or other type of interface can also be connected to the system bus 808.

The embedded control and communication electronics 802 can operate in a networked environment using logical connections via wired and/or wireless communications to one or more remote computers, phones, or other computing devices, such as workstations, server computers, routers, personal computers, portable computers, microprocessor-based entertainment appliances, peer devices or other common network nodes, etc. The embedded control and communication electronics 802 can connect to other devices/networks by way of antenna, port, network interface adaptor, wireless access point, modem, and/or the like.

The embedded control and communication electronics 802 is operable to communicate with any wireless devices or entities operatively disposed in wireless communication, e.g., a printer, scanner, desktop and/or portable computer, portable data assistant, communications satellite, any piece of equipment or location associated with a wirelessly detectable tag (e.g., a kiosk, news stand, restroom), and telephone. This includes at least WiFi and Bluetooth™ wireless technologies. Thus, the communication can be a predefined structure as with a conventional network or simply an ad hoc communication between at least two devices.

Figure 9:
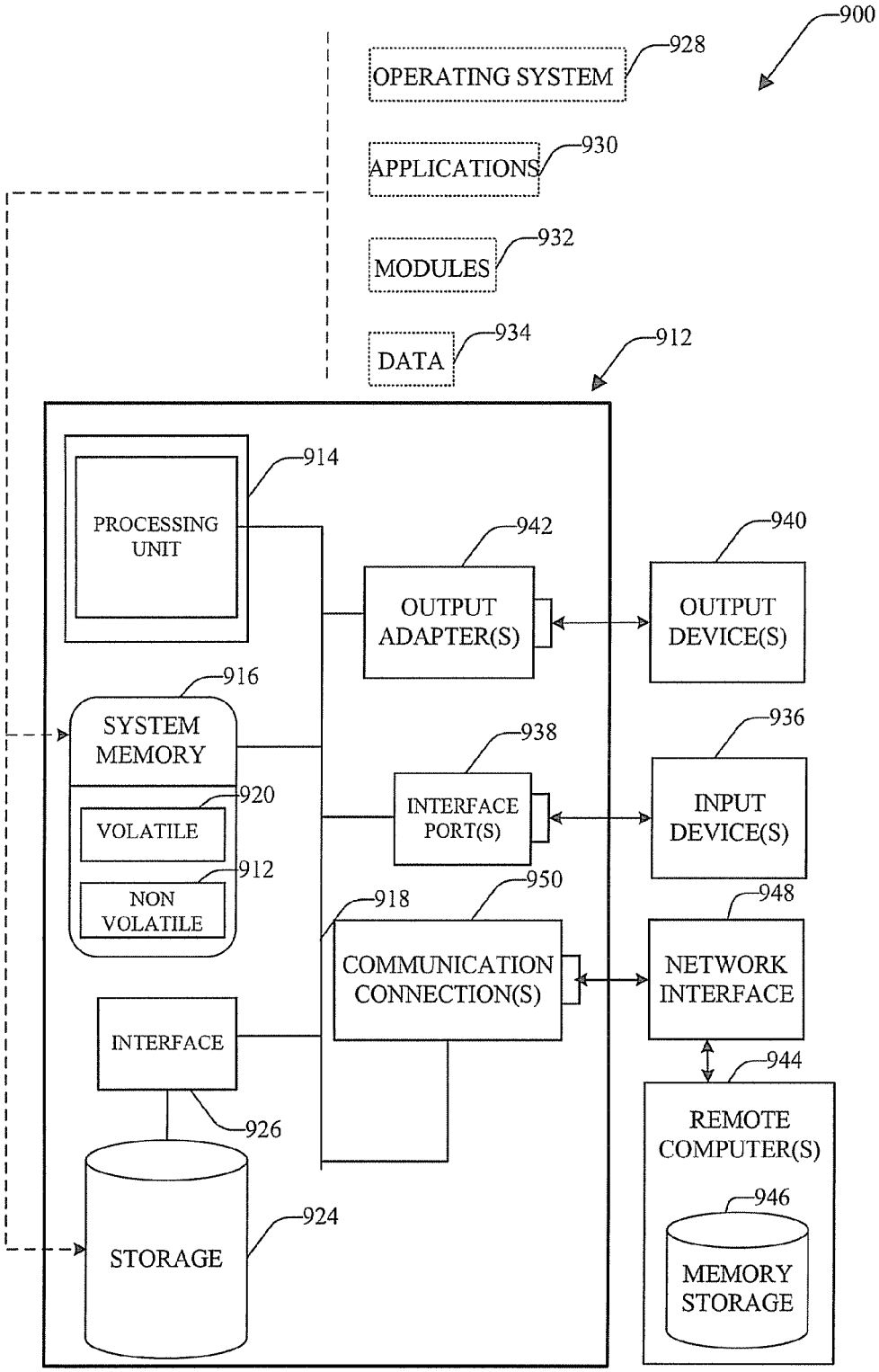
FIG. 9 depicts a schematic block diagram of a sample computing environment.

In order to provide a context for the various aspects of the disclosed subject matter, FIG. 9 as well as the following discussion is intended to provide a brief, general description of a suitable environment in which the various aspects of the disclosed subject matter may be implemented. While the subject matter has been described above in the general context of computer-executable instructions of a computer program that runs on a computer and/or computers, those skilled in the art will recognize that the invention also may be implemented in combination with other program modules. Generally, program modules include routines, programs, components, data structures, etc. that performs particular tasks and/or implement particular abstract data types. Moreover, those skilled in the art will appreciate that the inventive methods may be practiced with other computer system configurations, including single-processor or multiprocessor computer systems, mini-computing devices, mainframe computers, as well as personal computers, hand-held computing devices (e.g., personal digital assistant (PDA), phone, watch . . . ), microprocessor-based or programmable consumer or industrial electronics, and the like. The illustrated aspects may also be practiced in distributed computing environments where tasks are performed by remote processing devices that are linked through a communications network. However, some, if not all aspects of the invention can be practiced on standalone computers. In a distributed computing environment, program modules may be located in both local and remote memory storage devices.

With reference to FIG. 9, an exemplary environment 900 for implementing various aspects disclosed herein includes a computer 912 (e.g., desktop, laptop, server, hand held, programmable consumer or industrial electronics . . . ). Additionally, computer 912 can comprise an actual target hardware system, and can comprise an embedded computer that has all the characteristics of environment 900. The computer 912 includes a processing unit 914, a system memory 916, and a system bus 918. The system bus 918 couples system components including, but not limited to, the system memory 916 to the processing unit 914. The processing unit 914 can be any of various available microprocessors. Dual microprocessors and other multiprocessor architectures also can be employed as the processing unit 914.

The system bus 918 can be any of several types of bus structure(s) including the memory bus or memory controller, a peripheral bus or external bus, and/or a local bus using any variety of available bus architectures including, but not limited to, 8-bit bus, Industrial Standard Architecture (ISA), Micro-Channel Architecture (MSA), Extended ISA (EISA), Intelligent Drive Electronics (IDE), VESA Local Bus (VLB), Peripheral Component Interconnect (PCI), Universal Serial Bus (USB), Advanced Graphics Port (AGP), Personal Computer Memory Card International Association bus (PCMCIA), and Small Computer Systems Interface (SCSI). The system memory 916 includes volatile memory 920 and nonvolatile memory 922. The basic input/output system (BIOS), containing the basic routines to transfer information between elements within the computer 912, such as during start-up, is stored in nonvolatile memory 922. By way of illustration, and not limitation, nonvolatile memory 922 can include read only memory (ROM), programmable ROM (PROM), electrically programmable ROM (EPROM), electrically erasable ROM (EEPROM), or flash memory. Volatile memory 920 includes random access memory (RAM), which acts as external cache memory. By way of illustration and not limitation, RAM is available in many forms such as synchronous RAM (SRAM), dynamic RAM (DRAM), synchronous DRAM (SDRAM), double data rate SDRAM (DDR SDRAM), enhanced SDRAM (ESDRAM), Synchlink DRAM (SLDRAM), and direct Rambus RAM (DRRAM).

Computer 912 also includes removable/non-removable, volatile/non-volatile computer storage media. FIG. 9 illustrates, for example, disk storage 924. Disk storage 924 includes, but is not limited to, devices like a magnetic disk drive, floppy disk drive, tape drive, Jaz drive, Zip drive, LS-100 drive, flash memory card, or memory stick. In addition, disk storage 924 can include storage media separately or in combination with other storage media including, but not limited to, an optical disk drive such as a compact disk ROM device (CD-ROM), CD recordable drive (CD-R Drive), CD rewritable drive (CD-RW Drive) or a digital versatile disk ROM drive (DVD-ROM). To facilitate connection of the disk storage devices 924 to the system bus 918, a removable or non-removable interface is typically used such as interface 926.

It is to be appreciated that FIG. 9 describes software that acts as an intermediary between users and the basic computer resources described in suitable operating environment 900. Such software includes an operating system 928. Operating system 928, which can be stored on disk storage 924, acts to control and allocate resources of the computer system 912. System applications 930 take advantage of the management of resources by operating system 928 through program modules 932 and program data 934 stored either in system memory 916 or on disk storage 924. It is to be appreciated that the present invention can be implemented with various operating systems or combinations of operating systems.

A user enters commands or information into the computer 912 through input device(s) 936. Input devices 936 include, but are not limited to, a pointing device such as a mouse, trackball, stylus, touch pad, keyboard, microphone, joystick, game pad, satellite dish, scanner, TV tuner card, digital camera, digital video camera, web camera, and the like. These and other input devices connect to the processing unit 914 through the system bus 918 via interface port(s) 938. Interface port(s) 938 include, for example, a serial port, a parallel port, a game port, and a universal serial bus (USB). Output device(s) 940 use some of the same type of ports as input device(s) 936. Thus, for example, a USB port may be used to provide input to computer 912 and to output information from computer 912 to an output device 940. Output adapter 942 is provided to illustrate that there are some output devices 940 like displays (e.g., flat panel and CRT), speakers, and printers, among other output devices 940 that require special adapters. The output adapters 942 include, by way of illustration and not limitation, video and sound cards that provide a means of connection between the output device 940 and the system bus 918. It should be noted that other devices and/or systems of devices provide both input and output capabilities such as remote computer(s) 944.

Computer 912 can operate in a networked environment using logical connections to one or more remote computers, such as remote computer(s) 944. The remote computer(s) 944 can be a personal computer, a server, a router, a network PC, a workstation, a microprocessor based appliance, a peer device or other common network node and the like, and typically includes many or all of the elements described relative to computer 912. For purposes of brevity, only a memory storage device 946 is illustrated with remote computer(s) 944. Remote computer(s) 944 is logically connected to computer 912 through a network interface 948 and then physically connected via communication connection 950. Network interface 948 encompasses communication networks such as local-area networks (LAN) and wide-area networks (WAN). LAN technologies include Fiber Distributed Data Interface (FDDI), Copper Distributed Data Interface (CDDI), Ethernet/IEEE 802.3, Token Ring/IEEE 802.5 and the like. WAN technologies include, but are not limited to, point-to-point links, circuit-switching networks like Integrated Services Digital Networks (ISDN) and variations thereon, packet switching networks, and Digital Subscriber Lines (DSL).

Communication connection(s) 950 refers to the hardware/software employed to connect the network interface 948 to the bus 918. While communication connection 950 is shown for illustrative clarity inside computer 912, it can also be external to computer 912. The hardware/software necessary for connection to the network interface 948 includes, for exemplary purposes only, internal and external technologies such as, modems including regular telephone grade modems, cable modems, power modems and DSL modems, ISDN adapters, and Ethernet cards or components.

Figure 10:
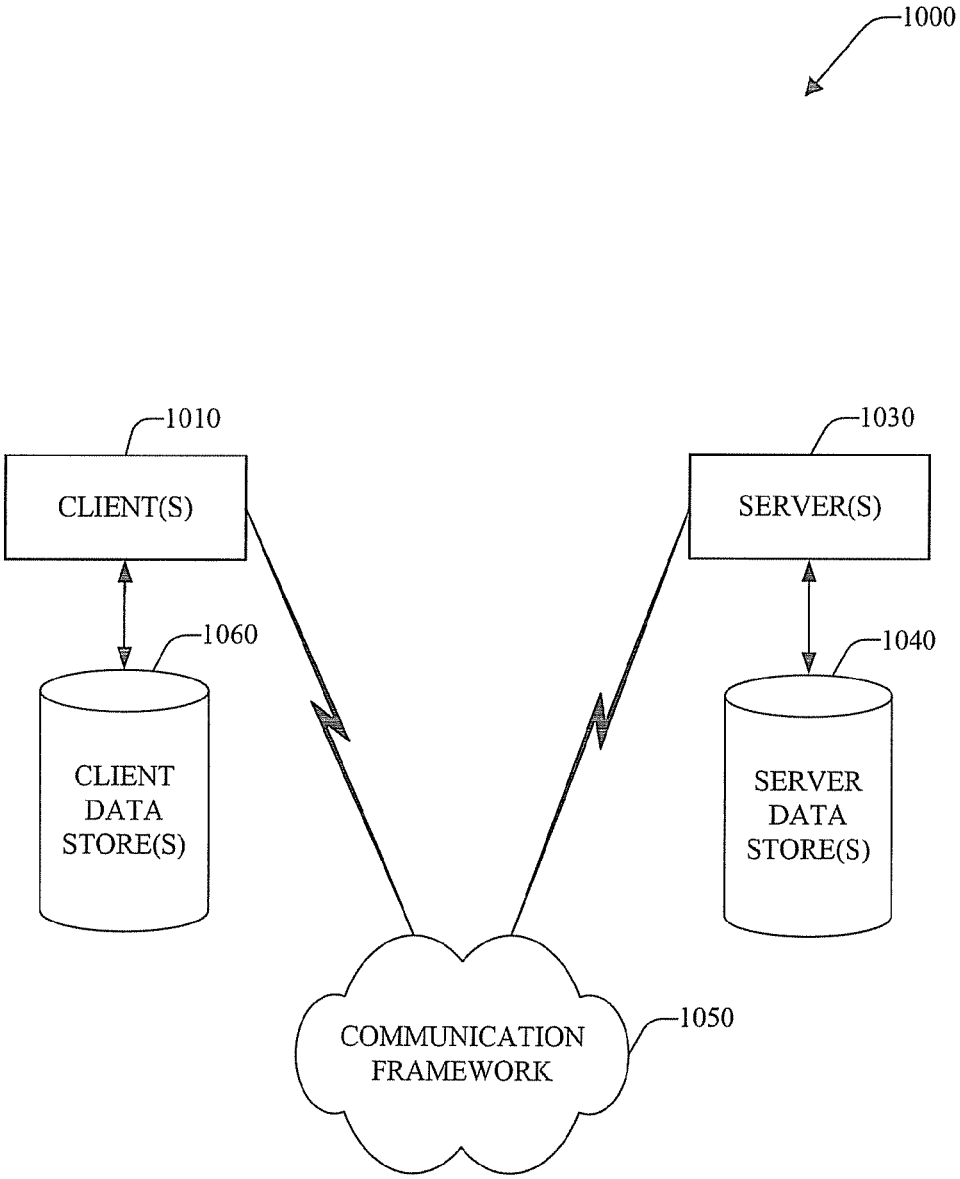
FIG. 10 depicts a schematic block diagram of a sample computing network environment.

FIG. 10 is a schematic block diagram of a sample-computing environment 1000 with which the present invention can interact. The system 1000 includes one or more client(s) 1010. The client(s) 1010 can be hardware and/or software (e.g., threads, processes, computing devices). The system 1000 also includes one or more server(s) 1030. Thus, system 1000 can correspond to a two-tier client server model or a multi-tier model (e.g., client, middle tier server, data server), amongst other models. The server(s) 1030 can also be hardware and/or software (e.g., threads, processes, computing devices). The servers 1030 can house threads to perform transformations by employing the present invention, for example. One possible communication between a client 1010 and a server 1030 may be in the form of a data packet adapted to be transmitted between two or more computer processes.

The system 1000 includes a communication framework 1050 that can be employed to facilitate communications between the client(s) 1010 and the server(s) 1030. The client(s) 1010 are operatively connected to one or more client data store(s) 1060 that can be employed to store information local to the client(s) 1010. Similarly, the server(s) 1030 are operatively connected to one or more server data store(s) 1040 that can be employed to store information local to the servers 1030.

What has been described above includes examples of the subject innovation. It is, of course, not possible to describe every conceivable combination of components or methodologies for purposes of describing the claimed subject matter, but one of ordinary skill in the art may recognize that many further combinations and permutations of the subject innovation are possible. Accordingly, the claimed subject matter is intended to embrace all such alterations, modifications, and variations that fall within the spirit and scope of the appended claims. Moreover, the above description of illustrated embodiments of the subject disclosure, including what is described in the Abstract, is not intended to be exhaustive or to limit the disclosed embodiments to the precise forms disclosed. While specific embodiments and examples are described herein for illustrative purposes, various modifications are possible that are considered within the scope of such embodiments and examples, as those skilled in the relevant art can recognize.

In this regard, while the disclosed subject matter has been described in connection with various embodiments and corresponding figures, where applicable, it is to be understood that other similar embodiments can be used, or modifications and additions can be made to the described embodiments, for performing the same, similar, alternative, or substitute function of the disclosed subject matter without deviating therefrom. Therefore, the disclosed subject matter should not be limited to any single embodiment described herein, but rather should be construed in breadth and scope in accordance with the appended claims below.

In addition to the various embodiments described herein, it is to be understood that other similar embodiments can be used or modifications and additions can be made to the described embodiment(s) for performing the same or equivalent function of the corresponding embodiment(s) without deviating therefrom. Still further, multiple processing chips or multiple devices can share the performance of one or more functions described herein, and similarly, storage can be effected across a plurality of devices. Accordingly, no single embodiment shall be considered limiting, but rather the various embodiments and their equivalents should be construed consistently with the breadth, spirit and scope in accordance with the appended claims.

It is also noted that the term industrial controller as used herein includes both PLCs and process controllers from distributed control systems and can include functionality that can be shared across multiple components, systems, and or networks. One or more industrial controllers can communicate and cooperate with various network devices across a network. This can include substantially any type of control, communications module, computer, I/O device, Human Machine Interface (HMI) that communicate via the network which includes control, automation, and/or public networks. The industrial controller can also communicate to and control various other devices such as Input/Output modules including Analog, Digital, Programmed/Intelligent I/O modules, other industrial controllers, communications modules, and the like. The network (not shown) can include public networks such as the Internet, Intranets, and automation networks such as Control and Information Protocol (CIP) networks including DeviceNet and ControlNet. Other networks include Ethernet, DH/DH+, Remote I/O, Fieldbus, Modbus, Profibus, wireless networks, serial protocols, and so forth. In addition, the network devices can include various possibilities (hardware and/or software components). These include components such as switches with virtual local area network (VLAN) capability, LANs, WANs, proxies, gateways, routers, firewalls, virtual private network (VPN) devices, servers, clients, computers, configuration tools, monitoring tools, and/or other devices.

The aforementioned systems/circuits/modules have been described with respect to interaction between several components. It can be appreciated that such systems/circuits and components can include those components or specified sub-components, some of the specified components or sub-components, and/or additional components, and according to various permutations and combinations of the foregoing. Sub-components can also be implemented as components communicatively coupled to other components rather than included within parent components (hierarchical). Additionally, it should be noted that one or more components may be combined into a single component providing aggregate functionality or divided into several separate sub-components, and any one or more middle layers, such as a management layer, may be provided to communicatively couple to such sub-components in order to provide integrated functionality. Any components described herein may also interact with one or more other components not specifically described herein but generally known by those of skill in the art.

In addition, while a particular feature of the subject innovation may have been disclosed with respect to only one of several implementations, such feature may be combined with one or more other features of the other implementations as may be desired and advantageous for any given or particular application. Furthermore, to the extent that the terms "includes," "including," "has," "contains," variants thereof, and other similar words are used in either the detailed description or the claims, these terms are intended to be inclusive in a manner similar to the term "comprising" as an open transition word without precluding any additional or other elements.

What is claimed is:

1. A system, comprising:

a current transformer including an integrated magnetic actuator component and configured to measure a current signal; and a lamination stack, including at least one surface that overlaps with a core of the current transformer, wherein the lamination stack is configured to increase magnetic coupling in the core.

2. The system of claim 1, wherein the lamination stack includes an I-shaped lamination strip.

3. The system of claim 2, wherein the lamination stack abuts to ends of an upper plate and a lower plate of the current transformer.

4. The system of claim 2, wherein the lamination stack is configured to self-align with ends of an upper plate and a lower plate of the current transformer.

5. The system of claim 1, further comprising, a primary bobbin that houses a primary coil of the current transformer, wherein the lamination stack is integrated within the primary bobbin.

6. The system of claim 5, wherein the primary bobbin retains an upper plate and a lower plate, which hold the primary coil inline with a secondary coil of the current transformer.

7. The system of claim 1, further comprising, one or more spring clips configured to apply a spring force to the lamination stack to form a tight interface between the lamination stack and at least one plate of the current transformer.

8. The system of claim 1, wherein the lamination stack includes at least one of a C-shaped or a U-shaped lamination strip that abuts to an upper and a lower surface of a lower and an upper plate of the current transformer, respectively.

9. The system of claim 1, further comprising, a control system interface component configured to communicate operational data with an industrial automation device.

10. The system of claim 9, wherein the control system interface component comprising electronics configured to measure circuit breaker related data, the control system interface component is further configured to communicate the circuit breaker related data to a disparate device communicatively coupled to the control system interface component.

11. The system of claim 9, wherein the control system interface component is further configured to receive a communication including a command to perform an action, wherein the action comprises an opening of a circuit breaker contact.

12. The system of claim 11, wherein the control system interface component is further configured to direct an overload voltage to an overload detection component and perform a remote shutdown in response to reception of the command.

13. The system of claim 1, further comprising, an overload measurement component configured to detect a current overload in a primary coil of the current transformer based on an increasing magnetic field strength surrounding the integrated magnetic actuator component.

14. The system of claim 13, wherein the overload measurement component is further configured to detect a voltage overload in a secondary coil of the current transformer based on a remote shutdown of supply voltage.

15. A method for improving magnetic coupling in a current transformer, comprising:

measuring current through a first coil of the current transformer;

measuring voltage across a second coil of the current transformer that is positioned inline with the first coil by employing a top plate and a bottom plate; and increasing an overlap between a lamination strip and at least one of the top plate or the bottom plate to increase magnetic coupling.

16. The method of claim 15, wherein the increasing includes abutting an I-shaped lamination strip to ends of the top plate and the bottom plate.

17. The method of claim 16, further comprising, applying a spring force to tighten the I-shaped lamination strip to the ends of the top plate and the bottom plate.

18. The method of claim 15, wherein the increasing includes abutting at least one of a C-shaped or a U-shaped lamination strip to a lower and upper surface of the top plate and the bottom plate respectively.

19. An industrial apparatus, comprising:

a primary coil that provides current based short circuit protection;

a secondary coil that provides voltage based overload protection, wherein the secondary coil is implemented inline with the primary coil by utilization of an upper plate and a lower plate that position cores around which the primary and secondary coils are wrapped; and a lamination stack, abutted to at least one of the upper plate or the lower plate, that improves magnetic coupling between the upper plate and the lower plate.

20. The industrial apparatus of claim 19, wherein the lamination stack includes an I-shaped lamination strip that abuts to ends of the upper plate and the lower plate.

* * * * *